US008960849B2

(12) United States Patent
Kyoso

(10) Patent No.: US 8,960,849 B2
(45) Date of Patent: Feb. 24, 2015

(54) METHOD FOR ANALYZING POSITIONAL DEVIATION OF HEAD MODULES, RECORDING MEDIUM, AND METHOD FOR ADJUSTING INKJET HEAD

(71) Applicant: FUJIFILM Corporation, Minato-ku, Tokyo (JP)

(72) Inventor: Tadashi Kyoso, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/058,990

(22) Filed: Oct. 21, 2013

(65) Prior Publication Data

US 2014/0111573 A1 Apr. 24, 2014

(30) Foreign Application Priority Data

Oct. 22, 2012 (JP) ..... 2012-232857

(51) Int. Cl.
*B41J 29/393* (2006.01)

(52) U.S. Cl.
USPC ..... 347/19; 347/5; 347/13

(58) Field of Classification Search
USPC ..... 347/5, 9, 12, 13, 14, 19
See application file for complete search history.

(56) References Cited

U.S. PATENT DOCUMENTS

| | | | | |
|---|---|---|---|---|
| 6,234,602 | B1 | 5/2001 | Soto et al. | |
| 8,162,431 | B2 * | 4/2012 | Sjolander et al. | 347/19 |
| 2001/0009429 | A1 | 7/2001 | Soto et al. | |
| 2003/0222934 | A1 * | 12/2003 | Choi et al. | 347/19 |
| 2007/0046715 | A1 * | 3/2007 | Yamanobe et al. | 347/19 |
| 2011/0234673 | A1 | 9/2011 | Ueshima | |

FOREIGN PATENT DOCUMENTS

| | | | |
|---|---|---|---|
| EP | 1034939 | A1 | 9/2000 |
| JP | 2002079657 | A | 3/2002 |
| JP | 2003-324610 | A | 11/2003 |
| JP | 2011073185 | A | 4/2011 |

OTHER PUBLICATIONS

The extended European search report issued on Feb. 5, 2014, which corresponds to European Patent Application No. 13189267.1-1701 and is related to U.S. Appl. No. 14/058,990.

* cited by examiner

*Primary Examiner* — Lam S Nguyen
(74) *Attorney, Agent, or Firm* — Studebaker & Brackett PC

(57) ABSTRACT

A method for analyzing positional deviation of head modules of an inkjet head having head modules connected and joined with each other includes: dividing a printing pattern and thereby creating division patterns; obtaining conversion factors of the nozzles of each division pattern; changing the number of nozzles used in calculation and thereby obtain a minimum value of a standard error of a positional deviation shift amount; changing the number of divisions of the division patterns and performing the calculation of the conversion factor and the standard error with the changed division patterns; determining the number of divisions and the number of nozzles with which the value of the standard error is minimal; and creating an analysis chart with the determined number of divisions and calculating the positional deviation shift amount based upon an average value of the positional deviation shift amounts of nozzles corresponding to the determined number of nozzles.

19 Claims, 20 Drawing Sheets

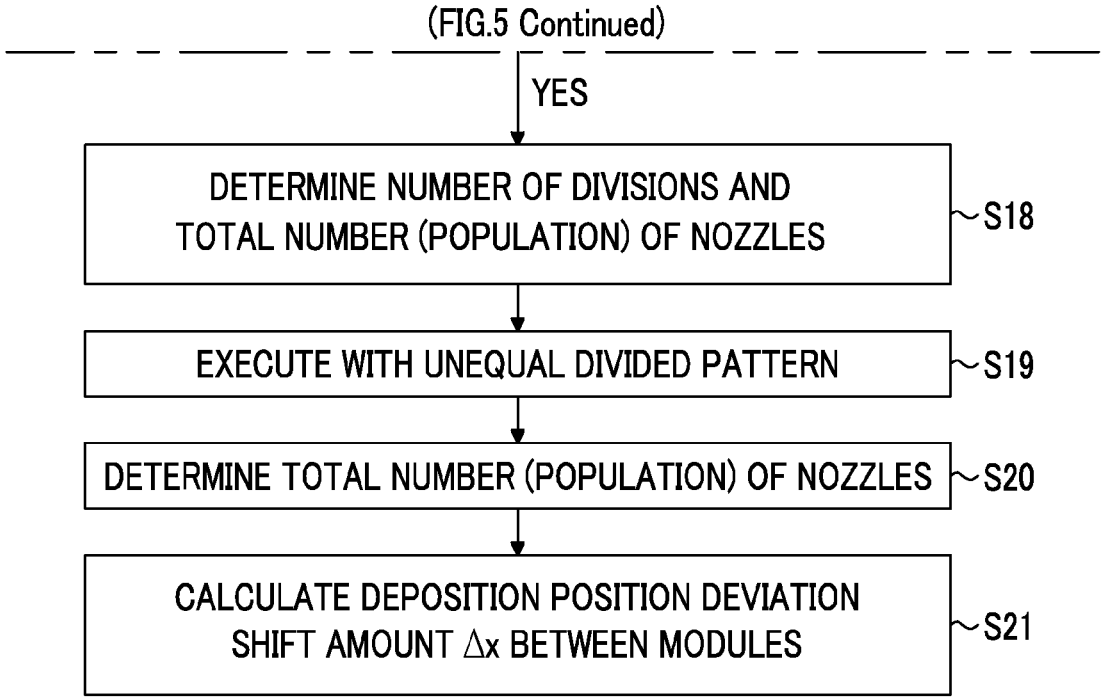
(FIG.5 Continued)
YES
DETERMINE NUMBER OF DIVISIONS AND TOTAL NUMBER (POPULATION) OF NOZZLES
S18
EXECUTE WITH UNEQUAL DIVIDED PATTERN
S19
DETERMINE TOTAL NUMBER (POPULATION) OF NOZZLES
S20
CALCULATE DEPOSITION POSITION DEVIATION SHIFT AMOUNT Δx BETWEEN MODULES
S21

FIG. 9A

| LINE# | A16 | A15 | A14 | A13 | A12 | A11 | A10 | A9 | A8 | A7 | A6 | A5 | A4 | A3 | A2 | A1 |
|---|---|---|---|---|---|---|---|---|---|---|---|---|---|---|---|---|
| NOZZLE# | 1 | 13 | 25 | 37 | 49 | 61 | 73 | 85 | 97 | 109 | 121 | 133 | 145 | 157 | 169 | 181 |
| COORDINATE | −15p | −14p | −13p | −12p | −11p | −10p | −9p | −8p | −7p | −6p | −5p | −4p | −3p | −2p | −1p | 0 |

| LINE# | B1 | B2 | B3 | B4 | B5 | B6 | B7 | B8 | B9 | B10 | B11 | B12 | B13 | B14 | B15 |
|---|---|---|---|---|---|---|---|---|---|---|---|---|---|---|---|
| NOZZLE# | 193 | 205 | 217 | 229 | 241 | 253 | 265 | 277 | 289 | 301 | 313 | 325 | 337 | 349 | 361 |
| COORDINATE | p+Δx | 2p+Δx | 3p+Δx | 4p+Δx | 5p+Δx | 6p+Δx | 7p+Δx | 8p+Δx | 9p+Δx | 10p+Δx | 11p+Δx | 12p+Δx | 13p+Δx | 14p+Δx | 15p+Δx |

FIG. 9B

| LINE# | A17 | A16 | A15 | A14 | A13 | A12 | A11 | A10 | A9 | A8 | A7 | A6 | A5 | A4 | A3 | A2 |
|---|---|---|---|---|---|---|---|---|---|---|---|---|---|---|---|---|
| NOZZLE# | 1 | 13 | 25 | 37 | 49 | 61 | 73 | 85 | 97 | 109 | 121 | 133 | 145 | 157 | 169 | 181 |
| COORDINATE | −15p | −14p | −13p | −12p | −11p | −10p | −9p | −8p | −7p | −6p | −5p | −4p | −3p | −2p | −1p | 0 |

| LINE# | A1 | B1 | B2 | B3 | B4 | B5 | B6 | B7 | B8 | B9 | B10 | B11 | B12 | B13 | B14 |
|---|---|---|---|---|---|---|---|---|---|---|---|---|---|---|---|
| NOZZLE# | 193 | 205 | 217 | 229 | 241 | 253 | 265 | 277 | 289 | 301 | 313 | 325 | 337 | 349 | 361 |
| COORDINATE | p | 2p+Δx | 3p+Δx | 4p+Δx | 5p+Δx | 6p+Δx | 7p+Δx | 8p+Δx | 9p+Δx | 10p+Δx | 11p+Δx | 12p+Δx | 13p+Δx | 14p+Δx | 15p+Δx |

FIG. 10

| LINE# | A4 | A3 | A2 | A1 | B1 | B2 | B3 | B4 |
|---|---|---|---|---|---|---|---|---|
| CONVERSION FACTOR | -4.60 | -3.26 | -2.48 | -2.00 | 2.00 | 2.48 | 3.26 | 4.60 |

FIG. 11
| CONVERSION FACTOR AVERAGE | TOTAL NUMBER OF NOZZLES | STANDARD ERROR |
|---|---|---|
| 2. 00 | 24 | 1.22 |
| 2. 24 | 48 | 0.97 |
| 2. 58 | 72 | 0.91 |
| 3. 09 | 96 | 0.95 |
FIG. 12A
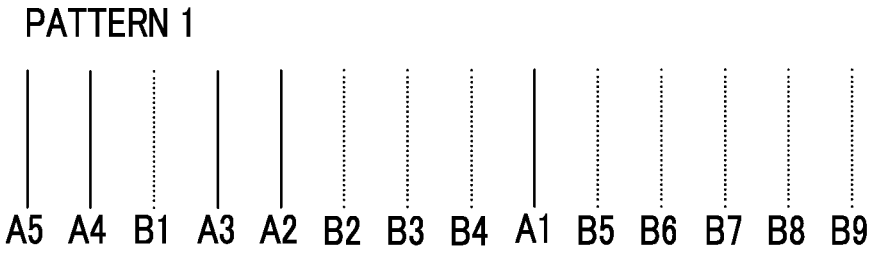
FIG. 12B
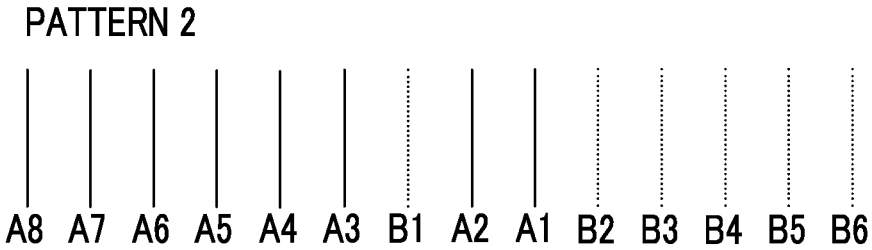
FIG. 12C
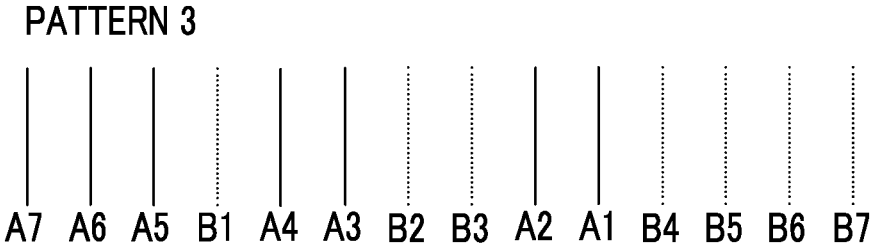

FIG. 13

| LINE# | A13 | A12 | A11 | A10 | A9 | A8 | A7 | A6 | A5 | B1 | A4 | A3 | B2 | B3 | A2 | A1 |
|---|---|---|---|---|---|---|---|---|---|---|---|---|---|---|---|---|
| NOZZLE# | 1 | 12 | 23 | 34 | 45 | 56 | 67 | 78 | 89 | 100 | 111 | 122 | 133 | 144 | 155 | 166 |
| COORDINATE | −15p | −14p | −13p | −12p | −11p | −10p | −9p | −8p | −7p | −6p+Δx | −5p | −4p | −3p+Δx | −2p+Δx | −1p | 0 |

| LINE# | B4 | B5 | B6 | B7 | B8 | B9 | B10 | B11 | B12 | B13 | B14 | B15 | B16 | B17 | B18 |
|---|---|---|---|---|---|---|---|---|---|---|---|---|---|---|---|
| NOZZLE# | 177 | 188 | 199 | 210 | 221 | 232 | 243 | 254 | 265 | 276 | 287 | 298 | 309 | 320 | 331 |
| COORDINATE | p+Δx | 2p+Δx | 3p+Δx | 4p+Δx | 5p+Δx | 6p+Δx | 7p+Δx | 8p+Δx | 9p+Δx | 10p+Δx | 11p+Δx | 12p+Δx | 13p+Δx | 14p+Δx | 15p+Δx |

PATTERN 1

PATTERN 2

PATTERN 3

PATTERN 4

FIG. 15

| CONVERSION FACTOR AVERAGE | TOTAL NUMBER OF NOZZLES | STANDARD ERROR |
|---|---|---|
| 1. 57 | 42 | 0. 725 |
| 1. 75 | 54 | 0. 714 |
| 1. 85 | 60 | 0. 717 |
| 1. 96 | 66 | 0. 724 |
| 2. 27 | 76 | 0. 780 |

FIG. 16

| NUMBER OF DIVISIONS | 8 | 9 | 10 | 11 | 12 |
|---|---|---|---|---|---|
| STANDARD ERROR | 1.12 μm (N=48) | 0.70 μm (N=58) | 0.71 μm (N=66) | 0.70 μm (N=60) | 0.91 μm (N=72) |

PATTERN 1

PATTERN 2

PATTERN 3

FIG. 18

| LINE# | A13 | A12 | A11 | A10 | A9 | A8 | A7 | A6 | A5 | B1 | B' | A3 | B2 | B3 | A2 | A1 |
|---|---|---|---|---|---|---|---|---|---|---|---|---|---|---|---|---|
| NOZZLE# | 1 | 12 | 23 | 34 | 45 | 56 | 67 | 78 | 89 | 100 | 112 | 122 | 133 | 144 | 155 | 166 |
| COORDINATE | −15p | −14p | −13p | −12p | −11p | −10p | −9p | −8p | −7p | −6p+Δx | −5p+Δx+21.2 | −4p | −3p+Δx | −2p+Δx | −1p | 0 |

| LINE# | B4 | A' | B6 | B7 | B8 | B9 | B10 | B11 | B12 | B13 | B14 | B15 | B16 | B17 | B18 |
|---|---|---|---|---|---|---|---|---|---|---|---|---|---|---|---|
| NOZZLE# | 177 | 186 | 199 | 210 | 221 | 232 | 243 | 254 | 265 | 276 | 287 | 298 | 309 | 320 | 331 |
| COORDINATE | p+Δx | 2p+Δx−42.3 | 3p+Δx | 4p+Δx | 5p+Δx | 6p+Δx | 7p+Δx | 8p+Δx | 9p+Δx | 10p+Δx | 11p+Δx | 12p+Δx | 13p+Δx | 14p+Δx | 15p+Δx |

FIG. 19

| | CONVERSION FACTOR AVERAGE | TOTAL NUMBER OF NOZZLES | STANDARD ERROR |
|---|---|---|---|
| 0 | 1. 31 | 31 | 0. 7062 |
| 1 | 1. 56 | 58 | 0. 6134 |
| 2 | 1. 72 | 74 | 0. 6001 |
| 3 | 1. 75 | 76 | 0. 6008 |
| 4 | 1. 65 | 56 | 0. 6620 |

METHOD FOR ANALYZING POSITIONAL DEVIATION OF HEAD MODULES, RECORDING MEDIUM, AND METHOD FOR ADJUSTING INKJET HEAD

BACKGROUND OF THE INVENTION

1. Field of the Invention

The present invention relates to a method for analyzing positional deviation of head modules, a non-transitory computer readable recording medium having a program recorded thereon, and a method for adjusting an inkjet head.

2. Description of the Related Art

In the field of inkjet rendering, in order to realize high rendering resolution and high productivity, a head module with multiple nozzles arranged in a two-dimensional manner is formed, and a plurality of head modules are arranged in a width direction of a recording medium, thereby constituting an elongated head (full line-type head) which covers a rendering region of the overall width of the recording medium. An inkjet rendering system (single pass system) in which the recording medium is relatively scanned in a direction perpendicular to a width direction of the elongated head only once to form an image on the recording medium is known.

When a plurality of head modules are arranged to form an inkjet head as described above, if the head modules are not joined with each other with high precision, all head modules are moved (shifted) in a direction of either adjacent module. Thus, there is a problem in that a nozzle interval differs in the joint portion of the head modules, and quality of an image to be formed is degraded.

In order to solve the above-described problem, for example, JP2002-79657A describes recording with each of adjacent short heads, forming a recording pattern, and detecting the position JP2011-73185A describes printing a small pattern having predetermined concentration, and determining the position of a nozzle column on the basis of a difference in concentration of a printed image portion.

SUMMARY OF THE INVENTION

However, in the method described in JP2002-79657A, precision is not sufficient, and further improvement of precision is required. In the method described in JP2011-73185A, since an appropriate position is determined by concentration measurement, there is a problem in that the result changes depending on chart concentration which is affected by variation in ejection droplet volume.

The present invention has been made in consideration of the above-described situation, and an object of the invention is to provide a method for analyzing positional deviation of head modules capable of measuring a deposition positional deviation shift amount of modules with high precision, a non-transitory computer readable recording medium having a program recorded thereon, and a method for adjusting an inkjet head.

In order to attain the above-described object, an aspect of the present invention provides a method for analyzing positional deviation of head modules of an inkjet head, in which a plurality of head modules each having a plurality of nozzles ejecting a liquid arranged therein are connected and joined with each other, and adjacent head modules have overlapping regions. The method includes a division pattern creation step of dividing a printing pattern by the head modules and thereby creating division patterns, a conversion factor calculation step of obtaining conversion factors of the nozzles of each division pattern, a standard error calculation step of changing the number of nozzles used in calculation and thereby obtain a minimum value of a standard error of a positional deviation shift amount of the head modules, a repetition step of changing the number of divisions of the division patterns and performing the conversion factor calculation step and the standard error calculation step with the changed division patterns, a determination step of determining the number of divisions and the number of nozzles with which the value of the standard error is minimal, and a shift amount calculation step of creating an analysis chart with the number of divisions determined in the determination step and calculating the positional deviation shift amount of the head modules based upon an average value of the positional deviation shift amounts of nozzles corresponding to the number of nozzles determined in the determination step.

According to the above aspects of the invention, the number of divisions of the printing pattern and the number of nozzles used in calculation of the standard error in each of the division patterns corresponding to the number of divisions changes, thereby obtaining the minimum value of the standard error of the positional deviation shift amount of the head modules. Accordingly, the positional deviation shift amount of the head modules is calculated with the number of divisions and the number of nozzles with which the standard error is minimum value, thereby improving precision of the positional deviation shift amount of the head modules.

In the method for analyzing positional deviation of head modules according to another aspect of the present invention, in the division pattern creation step, nozzle lines may be divided at regular intervals.

According to the method for analyzing positional deviation of head modules according to the above aspect, since division in the division pattern creation step is equal division in which nozzle lines are at regular intervals, the patterns can be easily created. Also, visual confirmation of the quality of an ejection state can be made.

The method for analyzing positional deviation of head modules according to another aspect of the present invention may further include a division pattern change step of, after the determination step, changing at least one nozzle to a nozzle of another module and creating the division patterns with the number of divisions determined in the determination step, in which the conversion factor calculation step and the standard error calculation step are performed with the division patterns created in the division pattern change step.

According to the method for analyzing positional deviation of head modules of the above aspect, a division pattern in which the nozzles are at regular intervals is created, the number of divisions and the number of nozzles are determined, at least one nozzle in the determined division pattern is changed to a nozzle in another module, and the standard error is calculated by the same method. In regard to a division pattern to be formed, since patterns in which nozzles are replaced between adjacent modules increase, it is possible to further reduce the standard error, thereby further improving precision of the deposition positional deviation shift amount $\Delta x$.

In the method for analyzing positional deviation of head modules according to another aspect of the present invention, in the division of the division pattern creation step, nozzle lines may be divided with the interval of the nozzles being irregular.

In the method for analyzing positional deviation of head modules according to the above aspect, since the division patterns are made in a manner such that the interval of the nozzle lines is not regular, thereby increasing patterns in which nozzles are replaced between adjacent modules, it is possible to further reduce the standard error, thereby further improving precision of Δx.

In the method for analyzing positional deviation of head module according to another aspect of the present invention, the standard error may be calculated by the conversion factor×random deposition deviation/√the total number of nozzles used in the standard error calculation.

According to the method for analyzing positional deviation of head modules of the above aspect, the standard error can be calculated by the above-described expression.

In the method for analyzing positional deviation of head modules according to another aspect of the present invention, in the standard error calculation step, the nozzles may be used in an ascending order of the conversion factors, and thereby the standard error may be calculated.

According to the method for analyzing positional deviation of head modules of the above aspect, the standard error is calculated using a nozzle having a small conversion factor, thereby reducing the standard error and improving precision of Δx.

In the method for analyzing positional deviation of head modules according to another aspect of the present invention, the positional deviation shift amount of the head modules in the shift amount calculation step may be obtained by the conversion factor of each nozzle×the positional deviation amount, and an approximated curve may be created using nozzle lines of division patterns on both sides of the nozzle of the analysis chart and the positional deviation amount may be obtained by the difference between the position of the approximated curve of the corresponding nozzle and an actual deposition position.

According to the method for analyzing positional deviation of head modules of the above aspect, an actual positional deviation amount, for example, may be measured based upon based upon the difference between an ideal position obtained with neighboring nozzles and an actual position.

In the method for analyzing positional deviation of head modules according to another aspect of the present invention, the approximated curve may be created using fifteen nozzle lines on both sides of the corresponding nozzle.

According to the method for analyzing positional deviation of head modules of the above aspect, fifteen nozzles on both sides of the nozzle used in measuring the deviation amount are used in creating the approximated curve, thereby obtaining the deviation amount with desired precision.

In order to attain the above-described object, another aspect of the present invention provides a non-transitory computer readable recording medium having a program recorded thereon which causes a computer to execute the method for analyzing positional deviation of head modules described above.

According to the above aspect of the present invention, the method for analyzing positional deviation of head modules described above can be used as a non-transitory computer readable recording medium having a program recorded thereon.

In order to attain the above-described object, another aspect of the present invention provides a method for adjusting an inkjet head for adjusting the positions of head modules using a positional deviation shift amount Δx of the head modules measured by the method for analyzing positional deviation of head modules.

According to the above aspect of the invention, since the positional deviation shift amount Δx of the head modules can be obtained with high precision, the inkjet head is adjusted on the basis of Δx, thereby reducing the positional deviation shift amount Δx.

According to the method for analyzing positional deviation of head modules, the non-transitory computer readable recording medium having a program recorded thereon, and the method for adjusting an inkjet head, since the number of divisions of printing patterns and the number of nozzles with reduced standard errors are obtained in advance to obtain the positional deviation shift amount of the head modules, it is possible to improve precision of the positional deviation shift amount. The head modules are adjusted on the basis of the positional deviation shift amount, thereby further reducing the positional deviation shift amount.

BRIEF DESCRIPTION OF THE DRAWINGS

FIGS. 9A and 9B are tables showing the relationship between a nozzle and a coordinate for creating approximated curves of nozzle lines A1(*a*) and A2(*b*) in the division pattern of 12 divisions.

FIG. 10 is a table showing the relationship between a nozzle line and a conversion factor in the division pattern of 12 divisions.

FIG. 11 is a table showing the relationship between the total number of nozzles and a standard error in the division patterns of 12 divisions.

FIGS. 12A to 12C are diagrams showing the relationship between a nozzle line and a module in a division pattern of 11 divisions.

FIG. 13 is a table showing the relationship between a nozzle and a coordinate for creating approximated curve of a nozzle line A1 in the division pattern 3 of 11 divisions.

FIG. 15 is a table showing the relationship between the total number of nozzles and a standard error in the division pattern of 10 divisions.

FIG. 16 is a table showing the relationship between the number of divisions, the total number of nozzles, and a standard error.

FIG. 18 is a table showing the relationship between a nozzle and a coordinate for creating an approximated curve of a nozzle line A1 in the unequal division pattern 3 of FIG. 17C.

FIG. 19 is a table showing the relationship between the total number of nozzles and a standard error in the unequal division patterns of FIGS. 17A to 17C.

DESCRIPTION OF THE PREFERRED EMBODIMENTS

Hereinafter, a preferred embodiment of the invention will be described referring to the accompanying drawings.

First, a head module to which the invention is applied, an inkjet head having a plurality of head modules, and an inkjet recording apparatus having an inkjet head will be described.

<<Overall Configuration of Inkjet Recording Apparatus>>

Figure 1:
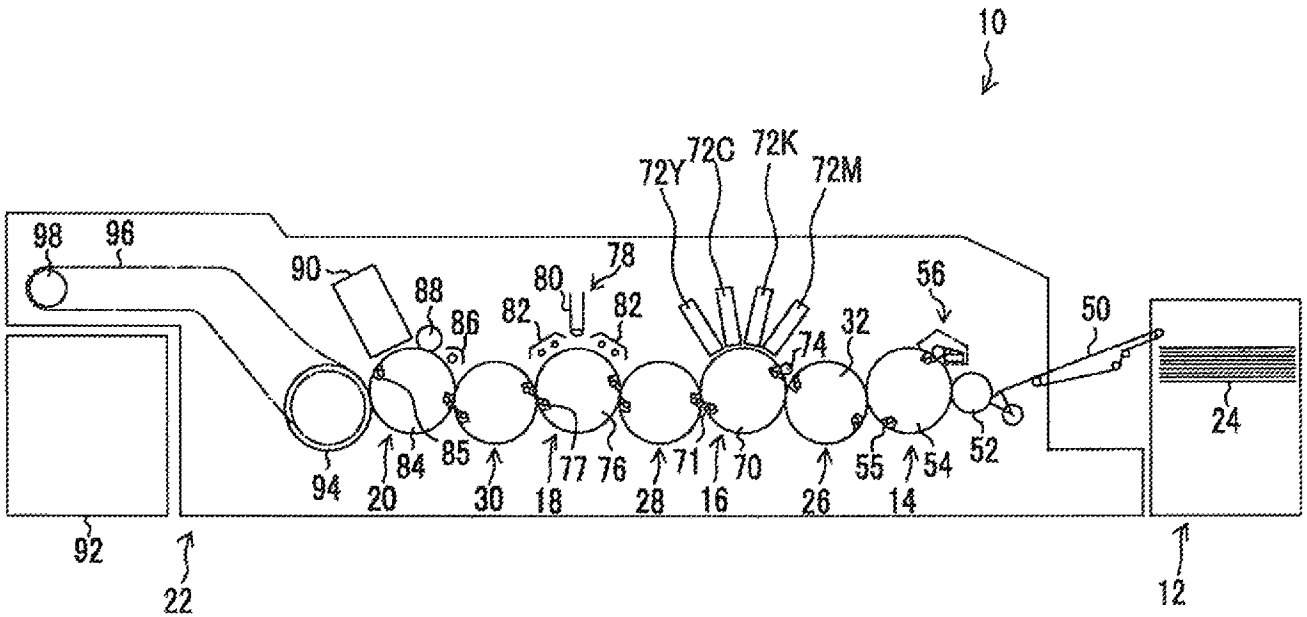
FIG. 1 is an overall configuration diagram of an inkjet recording apparatus.

First, the overall configuration of an inkjet recording apparatus will be described. FIG. 1 is a configuration diagram showing the overall configuration of an inkjet recording apparatus.

The inkjet recording apparatus 10 is an impression cylinder direct-rendering inkjet recording apparatus which ejects ink droplets of a plurality of colors from inkjet heads 72M, 72K, 72C, and 72Y on a recording medium 24 (for convenience, referred to as "sheet") held in an impression cylinder (rendering drum 70) of the rendering unit 16 to form a desired color image. The inkjet recording apparatus 10 is also an on-demand image forming apparatus to which a two-liquid reaction (aggregation) system is applied, which applies a processing liquid (in this case, a aggregation processing liquid) onto the recording medium 24 before the ejection of ink droplets and causes the processing liquid react with the ink liquid to perform image formation on the recording medium 24.

As shown in the drawing, the inkjet recording apparatus 10 primarily includes a sheet feed unit 12, a processing liquid application unit 14, a rendering unit 16, a drying unit 18, a fixing unit 20, and a sheet discharge unit 22.

(Sheet Feed Unit)

The sheet feed unit 12 is a mechanism which feeds the recording medium 24 to the processing liquid application unit 14, and in the sheet feed unit 12, recording mediums 24 as sheets of paper are stacked. The sheet feed unit 12 is provided with a sheet feed tray 50, and the recording mediums 24 are fed from the sheet feed tray 50 to the processing liquid application unit 14 one by one.

In the inkjet recording apparatus 10 of this example, as the recording medium 24, a plurality of recording mediums 24 of different types or sizes (sheet size). In the sheet feed unit 12, a form in which a plurality of sheet trays (not shown) distinctively accumulating various types of recording mediums are provided, and sheet feed from a plurality of sheet trays to the sheet feed tray 50 is automatically switched may be made, or a form in which an operator selects or replaces a sheet tray if necessary may be made. In this example, although a sheet of paper (cut paper) is used as the recording medium 24, a configuration in which a continuous sheet (roll paper) of necessary size is cut and fed may be made.

(Processing Liquid Application Unit)

The processing liquid application unit 14 is a mechanism which applies a processing liquid to the recording surface of the recording medium 24. The processing liquid includes a color material aggregating agent which aggregates a color material (in this example, a pigment) in ink to be applied by the rendering unit 16, and the processing liquid comes into contact with ink, such that separation of the color material and a solvent in ink is promoted.

As shown in FIG. 1, the processing liquid application unit 14 includes a sheet feed cylinder 52, a processing liquid drum 54, and a processing liquid coating device 56. The processing liquid drum 54 is a drum which holds, rotates, and conveys the recording medium 24. The processing liquid drum 54 includes a claw-shaped holding unit (gripper) 55 on the outer circumferential surface thereof, and the recording medium 24 is sandwiched between the claw of the holding unit 55 and the circumferential surface of the processing liquid drum 54 to hold the leading end of the recording medium 24. The processing liquid drum 54 may be provided with an absorption hole on the outer circumferential surface thereof, and a suction unit which performs suction from the absorption hole may be connected thereto. Accordingly, the recording medium 24 can be in close contact with and held on the circumferential surface of the processing liquid drum 54.

Outside the processing liquid drum 54, the processing liquid coating device 56 is provided to face the circumferential surface of the processing liquid drum 54. The processing liquid coating device 56 has a processing liquid container in which the processing liquid is stored, an onyx roller which is partially dipped in the processing liquid of the processing liquid container, and a rubber roller which is pressed against the recording medium 24 on the processing liquid drum 54 to transfer the processing liquid after measuring to the recording medium 24. According to the processing liquid coating device 56, the processing liquid can be coated on the recording medium 24 while being measured.

The recording medium 24 with the processing liquid applied by the processing liquid application unit 14 is delivered from the processing liquid drum 54 to the rendering drum 70 of the rendering unit 16 through an intermediate conveying unit 26.

(Rendering Unit)

The rendering unit 16 includes a rendering drum (a second conveying body) 70, a sheet suppression roller 74, and inkjet heads 72M, 72K, 72C, and 72Y. Similarly to the processing liquid drum 54, the rendering drum 70 includes a claw-shaped holding unit (gripper) 71 on the outer circumferential surface thereof. The recording medium 24 fixed on the rendering drum 70 is conveyed such that the recording surface turns outward, and ink is applied from the inkjet heads 72M, 72K, 72C, and 72Y to the recording surface.

It is preferable that each of the inkjet heads 72M, 72K, 72C, and 72Y is a full-line inkjet recording head (inkjet head) which has a length corresponding to the maximum width of an image forming region in the recording medium 24. A nozzle column with a plurality of ink ejecting nozzles arranged over the overall width of the image forming region is formed on an ink ejection surface. Each of the inkjet heads 72M, 72K, 72C, and 72Y is provided so as to extend in a direction perpendicular to the conveying direction of the recording medium 24 (the rotation direction of the rendering drum 70).

The droplets of corresponding color ink are ejected from each of the inkjet heads 72M, 72K, 72C, and 72Y toward the recording surface of the recording medium 24 in close contact with and held on the rendering drum 70, whereby ink comes into contact with the processing liquid applied to the recording surface in advance by the processing liquid application unit 14, the color material (pigment) dispersed in ink is aggregated, and a color material aggregate is formed. Accordingly, a color material flow or the like on the recording medium 24 is prevented, and an image is formed on the recording surface of the recording medium 24.

In this example, although a configuration of reference colors (four colors) of CMYK is illustrated, a combination of ink colors or the number of colors is not limited to this embodiment, and if necessary, light ink, deep ink, and special color ink may be added. For example, a configuration in which an inkjet head ejecting light ink, such as light cyan or light magenta, is added may be made, and the arrangement order of the respective color heads is not particularly limited.

The recording medium 24 with an image formed thereon by the rendering unit 16 is delivered from the rendering drum 70 to a drying drum 76 of the drying unit 18 through the intermediate conveying unit 28.

(Drying Unit)

The drying unit 18 is a mechanism which dries moisture included in the solvent separated by a color material aggregation action, and as shown in FIG. 1, includes a drying drum 76 and a solvent driving device 78.

Similarly to the processing liquid drum 54, the drying drum 76 includes a claw-shaped holding unit (gripper) 77 on the outer circumferential surface, and is configured to hold the leading end of the recording medium 24 by the holding unit 77.

The solvent drying device 78 is arranged at a position facing the outer circumferential surface of the drying drum 76, and has a plurality of IR heaters 82 and warm air jet nozzles 80 arranged between the IR heaters 82.

The temperature and air capacity of warm air blown from each warm air jet nozzle 80 toward the recording medium 24 and the temperature of each IR heater 82 are appropriately adjusted, thereby realizing various drying conditions.

The surface temperature of the drying drum 76 is set to be equal to or higher than 50° C. Heating is performed from the rear surface of the recording medium 24 to promote drying, thereby preventing image breakdown during fixing. Although the upper limit of the surface temperature of the drying drum 76 is not particularly limited, from the viewpoint of safety (prevention of burn by high temperature) of a maintenance operation, such as cleaning of ink stuck to the surface of the drying drum 76, it is preferable that the upper limit of the surface temperature of the drying drum 76 is set to be equal to or lower than 75° C. (more preferably, equal to or lower than 60° C.).

The recording medium 24 is held on the outer circumferential surface of the drying drum 76 such that the recording surface of the recording medium 24 turns outward (that is, the recording medium 24 is curved such that the recording surface of the recording medium 24 becomes a convex side) and dried while being rotated and conveyed, thereby preventing the occurrence of wrinkling or floating of the recording medium 24 and thus reliably preventing drying irregularity due to wrinkling or floating.

The recording medium 24 dried by the drying unit 18 is delivered from the drying drum 76 to a fixing drum 84 of the fixing unit 20 through the intermediate conveying unit 30.

(Fixing Unit)

The fixing unit 20 has a fixing drum 84, a halogen heater 86, a fixing roller 88, and an inline sensor 90. Similarly to the processing liquid drum 54, the fixing drum 84 includes a claw-shaped holding unit (gripper) 85 on the outer circumferential surface, and is configured to hold the leading end of the recording medium 24 by the holding unit 85.

With the rotation of the fixing drum 84, the recording medium 24 is conveyed such that the recording surface turns outward, and for the recording surface, preliminary heating by the halogen heater 86, fixing by the fixing roller 88, and inspection by the inline sensor 90 are performed.

The halogen heater 86 is controlled at predetermined temperature (for example, 180° C.). Accordingly, preliminary heating of the recording medium 24 is performed.

The fixing roller 88 is a roller member which heats and pressurizes the dried ink to weld self-dispersion thermoplastic resin particulates and coats ink, and is configured to heat and pressurize the recording medium 24. Specifically, the fixing roller 88 is arranged so as to be pressed against the fixing drum 84, and is configured to form a nip roller along with the fixing drum 84. Accordingly, the recording medium 24 is sandwiched between the fixing roller 88 and the fixing drum 84 and nipped at a predetermined nip pressure (for example, 0.15 MPa), and fixing is performed.

The fixing roller 88 is constituted by a heating roller in which a halogen lamp is incorporated in a metal pipe, such as aluminum having excellent thermal conductivity, and is controlled at predetermined temperature (for example, 60 to 80° C.). The recording medium 24 is heated by the heating roller, whereby thermal energy equal to or higher than Tg temperature (glass transition point temperature) of the thermoplastic resin particulates included in ink is applied and the thermoplastic resin particulates are molten. Accordingly, plunging fixing is performed in the unevenness of the recording medium 24, the unevenness of the image surface is leveled, and glossiness is obtained.

In the embodiment of FIG. 1, although a configuration in which the single fixing roller 88 is provided is made, a configuration in which a plurality of stages are provided according to the thickness of the image layer or the Tg characteristics of the thermoplastic resin particulates may be made.

The inline sensor 90 is a measurement unit which measures a check pattern, the amount of moisture, surface temperature, glossiness, or the like for the image fixed to the recording medium 24, and a CCD line sensor or the like is applied.

According to the fixing unit 20 configured as above, since the thermoplastic resin particulates in the thin image layer formed by the drying unit 18 is heated and pressurized by the fixing roller 88 and molten, the image can be fixed onto the recording medium 24. The surface temperature of the fixing drum 84 is set to be equal to or higher than 50° C., whereby the recording medium 24 hold on the outer circumferential surface of the fixing drum 84 is heated from the rear surface and promoted to be dried, thereby image breakdown during fixing and increasing image intensity by the effect of increasing image temperature.

When a UV curable monomer is contained ink, moisture is volatilized by the drying unit, then UV is irradiated onto the image by the fixing unit including a UW irradiation lamp, and the UV curable monomer is cured and polymerized, thereby improving image intensity.

(Sheet Discharge Unit)

As shown in FIG. 1, the sheet discharge unit 22 is provided to follow the fixing unit 20. The sheet discharge unit 22 includes a discharge tray 92, and a transfer cylinder 94, a conveying belt 96, and a tension roller 98 are provided between the discharge tray 92 and the fixing drum 84 of the fixing unit 20 so as to be placed against the discharge tray 92 and the fixing drum 84 of the fixing unit 20. The recording medium 24 is transferred to the conveying belt 96 by the transfer cylinder 94 and discharged to the discharge tray 92.

Though not shown, in addition to the above-described configuration, the inkjet recording apparatus 10 of this example includes an ink storage/load unit which supplies ink to each of the inkjet heads 72M, 72K, 72C, and 72Y, a unit which supplies the processing liquid to the processing liquid application unit 14, a head maintenance unit which performs cleaning (wiping of the nozzle surface, purging, nozzle absorption, and the like) of each of the inkjet heads 72M, 72K, 72C, and 72Y, a position detection sensor which detects the position of the recording medium 24 on a sheet conveying path, a temperature sensor which detects the temperature of each unit of the apparatus, and the like.

Figure 2:
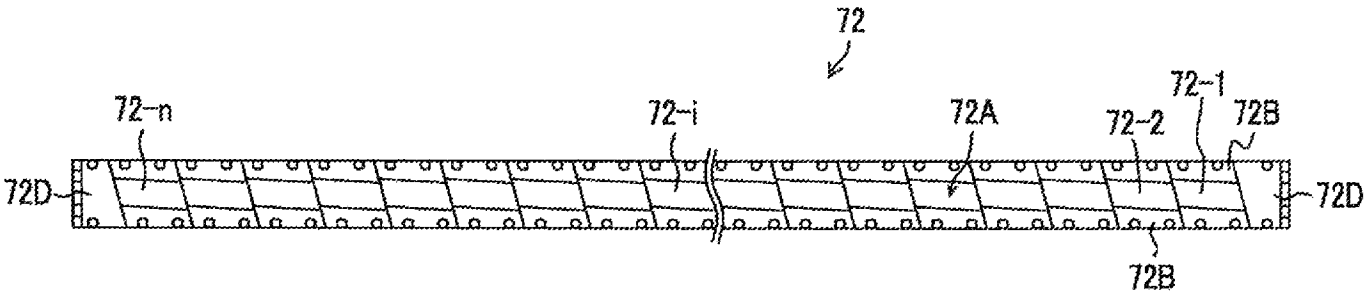
FIG. 2 is a plan view showing a configuration example of an inkjet head shown in FIG. 1.
Figure 3:
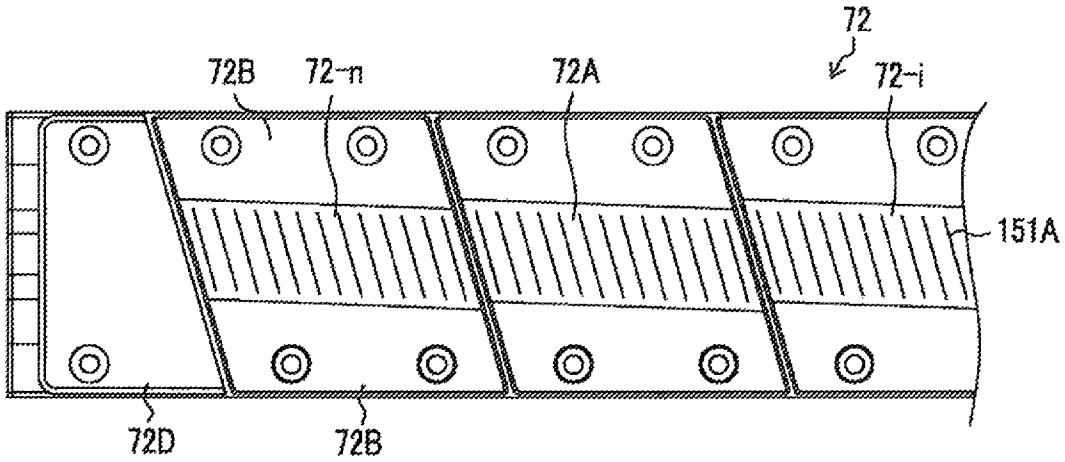
FIG. 3 is a partial enlarged view of FIG. 2.

FIG. 2 is a plan view showing a structure example of the head 72 and is a diagram when the head 72 is viewed from a nozzle surface 72A. FIG. 3 is a partial enlarged view of FIG. 2.

As shown in FIG. 2, the head 72 has a structure in which n head modules 72-*i* (where i=1, 2, 3, . . . , n) are joined with each other in a longitudinal direction (a direction perpendicular to the conveying direction of the recording medium 24 (see FIG. 1)), and a plurality of nozzles (not shown in FIG. 2) are provided over the length corresponding to the overall width of the recording medium.

Each head module 72-*i* is supported by a head module support member 72B from both sides in a latitudinal direction of the head 72. Both ends in the longitudinal direction of the head 72 are supported by a head support member 72D.

As shown in FIG. 3, each head module 72-*i* (n-th head module 72-*n*) has a structure in which a plurality of nozzles are arranged in a matrix. In FIG. 3, an oblique solid line with reference numeral 151A indicates a nozzle column in which a plurality of nozzles are arranged in a column.

Figure 4A:
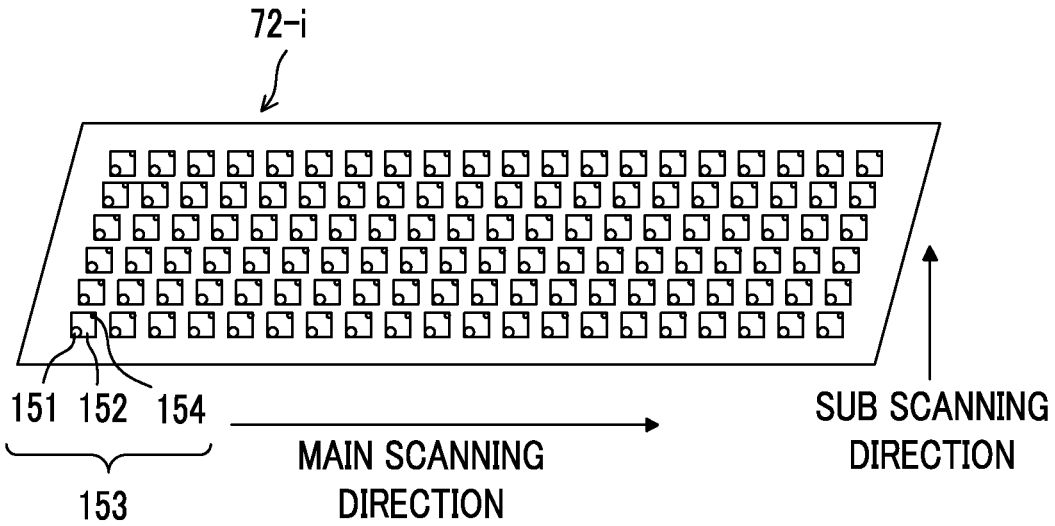
FIGS. 4A and 4B are perspective plan views of a head module shown in FIG. 2.
Figure 4B:
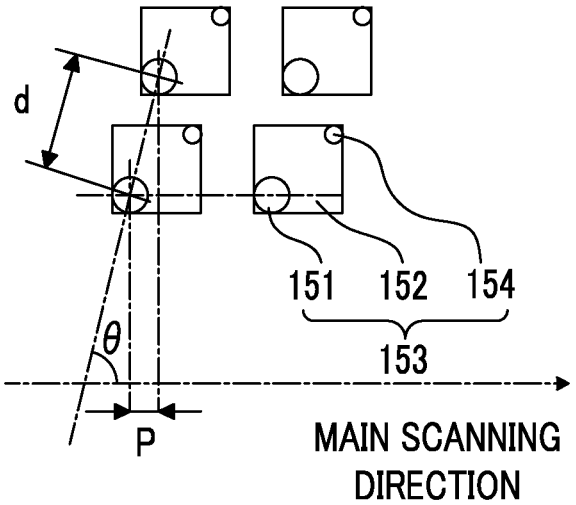

FIG. 4A is a perspective plan view of the head module 72-*i*, and FIG. 4B is an enlarged view of a part of FIG. 4A.

In order to densify a dot pitch formed on the recording medium 24, it is necessary to densify a nozzle pitch in the head 72. As shown in FIGS. 4A and 4B, the head module 72-*i* of this example has a structure in which a plurality of ink chamber units (droplet ejection element as a recording element unit) 153 each having a nozzle 151 as an ink ejection port, a pressure chamber 152 corresponding to each nozzle 151, and the like are arranged in a zigzag pattern and in a matrix (in a two-dimensional manner), thereby attaining densification of a substantial nozzle interval (projection nozzle pitch) so as to be arranged in the head longitudinal direction (the direction perpendicular to the conveying direction of the recording medium 24, main scanning direction).

The pressure chamber 152 provided corresponding to each nozzle 151 substantially has a planar shape of a square, the nozzle 151 is provided at one of both corners on the diagonal, and a supply port 154 is provided at the other corner. The shape of the pressure chamber 152 is not limited to this example, and the planar shape may have various forms including a polygonal, such as a quadrangle (rhombus, rectangle, or the like), a pentagon, or a hexagon, a circle, an ellipse, and the like.

As shown in FIG. 4B, multiple ink chamber units 153 having the above-described structure are arranged in a given arrangement pattern and in a lattice shape along a row direction along the main scanning direction and an oblique column direction at a given angle θ not perpendicular to the main scanning direction, thereby realizing a densified nozzle head of this example.

That is, with a structure in which a plurality of ink chamber units 153 at a given pitch d in the direction at the angle θ with respect to the main scanning direction, the pitch P of the nozzles projected so as to be arranged in the main scanning direction becomes d×cos θ, and in the main scanning direction, this structure can be equivalent to a structure in which the nozzles 151 are arranged linearly at a given pitch P. With this configuration, a densified nozzle configuration in which a nozzle column projected so as to be arranged in the main scanning direction reaches 2400 per pitch (2400 nozzles/pitch) can be realized.

The arrangement structure of the nozzles is not limited to the example shown in the drawing when carrying out the invention, various nozzle arrangement structures, such as an arrangement structure having one nozzle column in a sub-scanning direction, may be applied.

<<Calculation of Deposition Positional Deviation Shift Amount of Modules>>

Figure 5:
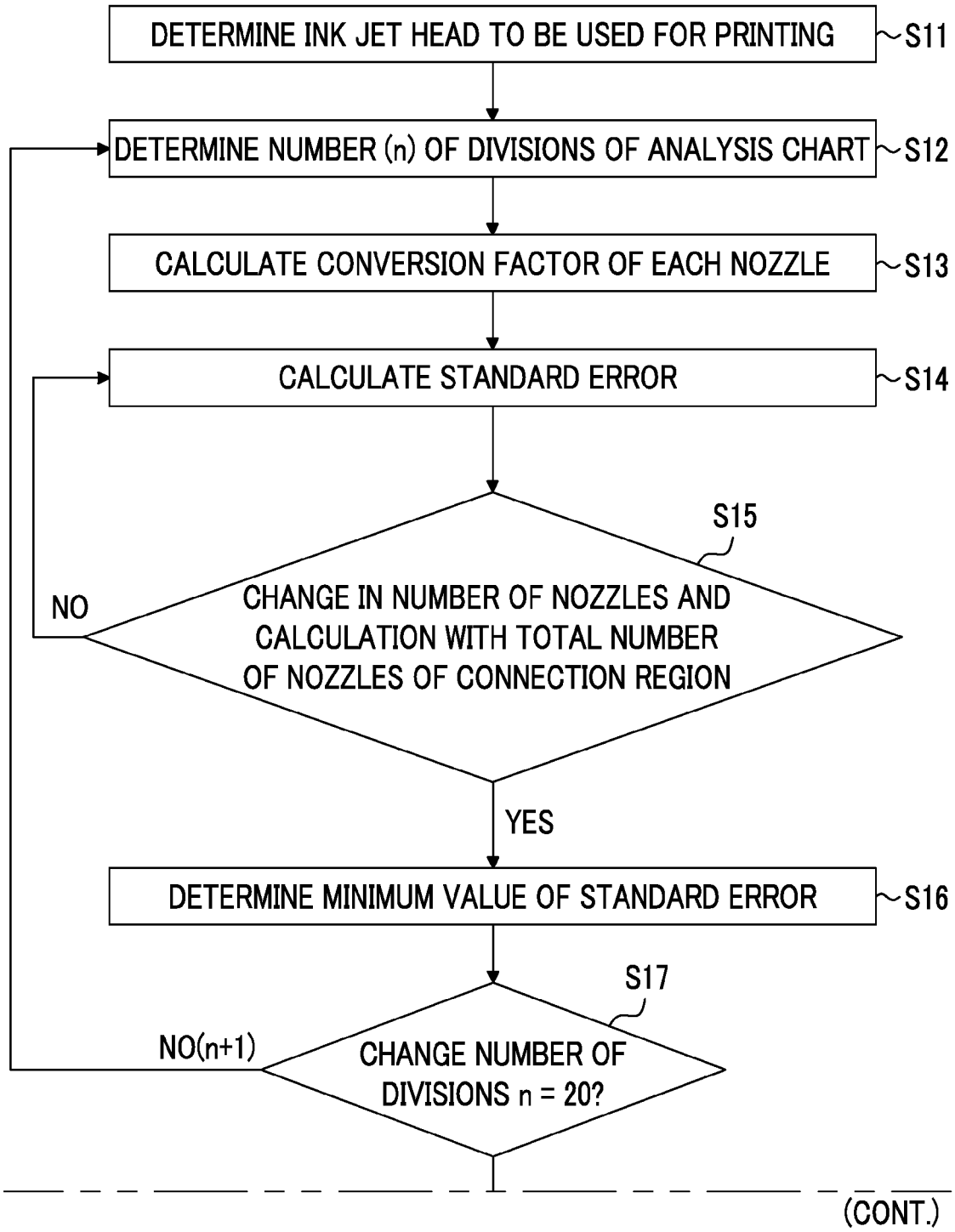
FIG. 5 is a flowchart showing a method for calculating a deposition positional deviation shift amount of head modules.

A calculation method which performs calculation with further improved precision of the deposition positional deviation shift amount will be described. FIG. 5 is a flowchart showing a method of calculating a deposition positional deviation shift amount.

As shown in FIG. 5, first, a head bar of an inkjet head for use in printing is determined (Step S11). Next, a loop for determining the number (n) of divisions of an analysis chart to inspect a deposition position of ink starts. First, the arbitrary number of divisions is determined, and a printing pattern is formed with the number of divisions (Step S12). A conversion factor of each nozzle is calculated according to the number of divisions (Step S13). Next, a loop for determining the number (population) of nozzles for use in calculation starts. The total number (population) of nozzles for use in calculation in an ascending order of the conversion factors calculated in Step S13, and a standard error is calculated (Step S14).

After the standard error is calculated in Step S14, the total number (population) of nozzles is changed, the process returns to Step S14, and the standard error is calculated. Calculation is performed up to the number of nozzles of a region where the nozzles of a neighboring module having the total number of nozzles are tangled (Step S15). The total number of nozzles having a minimum value from among the standard errors calculated in Steps S14 and S15 is determined (Step S16). After the minimum standard error is determined within the number of divisions, the number of divisions is changed to [number (n)+1 of divisions], the process returns to Step S12, Steps S12 to S16 are performed, and the total number of nozzles having the minimum standard error is determined within the number of divisions corresponding to the number of divisions+1. After the number of nozzles having the minimum standard error up to the number of divisions=20 (Step S17), the number of divisions having the minimum standard error and the total number of nozzles at this time are obtained, the number of divisions at this time is determined as a printing sample (analysis chart), and the number of population nozzles is defined as the number of nozzles for calculating the deposition positional deviation shift amount (Δx) (Step S18).

Although Steps S12 to S18 are performed by a method which performs equal nozzle division, unequal nozzle division is performed, whereby a standard error can be reduced and precision can be further increased (Step S19). Unequal nozzle division is performed with the number of divisions obtained in Step S18, and similarly to equal division, in Steps S13 to S16 shown in FIG. 5, the minimum value of the standard error is obtained, thereby determining the total number of nozzles (Step S20). The deposition positional deviation shift amount is calculated with the total number of nozzles obtained in Step S20, whereby the deposition positional deviation shift amount can be calculated with high precision compared to calculation with the total number of nozzles obtained in Step S18.

The use as a non-transitory computer readable recording medium having a program recorded thereon which causes a computer to execute each step shown in FIG. 5 can be made.

Next, each step will be described.

(Step S11) Determination of Inkjet Head

An inkjet head for use in image formation is determined.

(Step S12) Determination of the Number (n) of Divisions (Division Pattern Creation Step)

Figure 6:
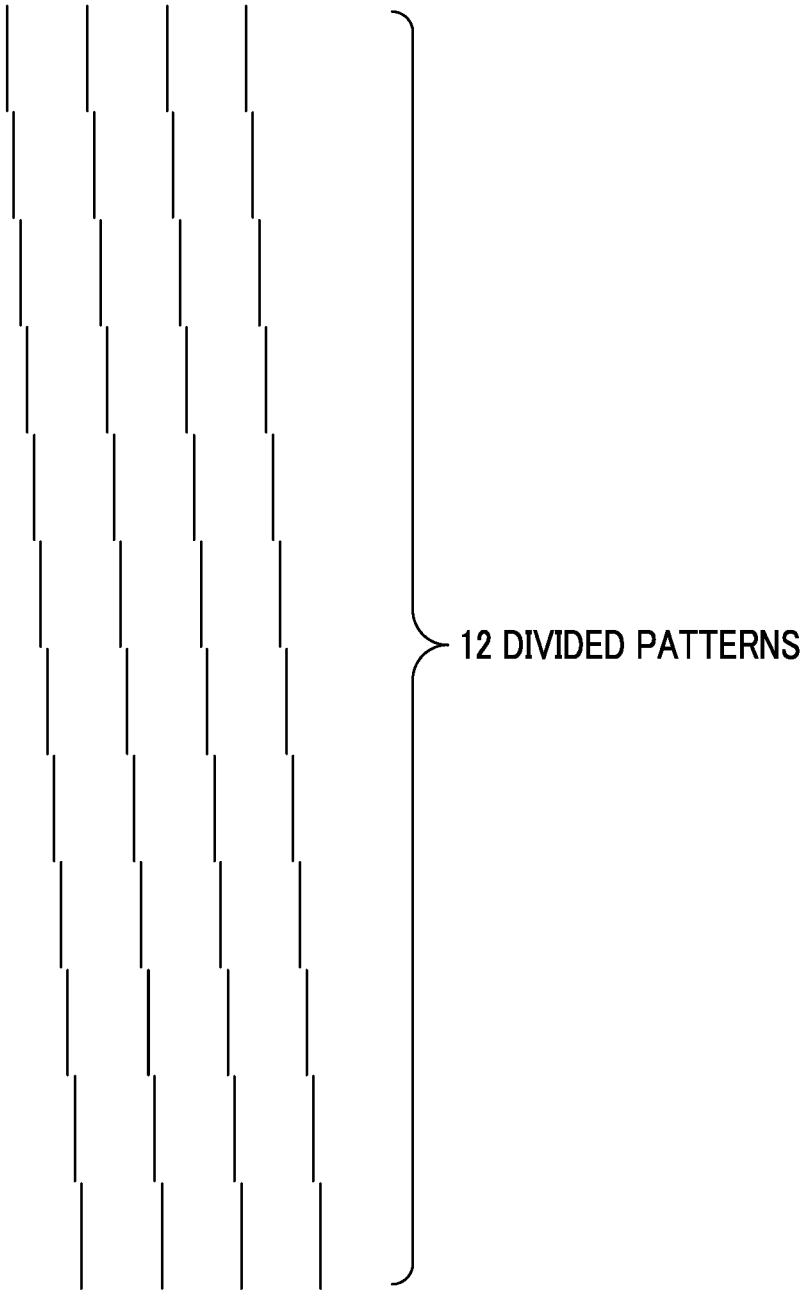
FIG. 6 is an analysis chart in which a division pattern is created with 12 divisions.

In this example, it is assumed that nozzles are arranged with 1200 dpi perpendicular to the conveying direction of the recording medium. FIG. 6 is a diagram in which an analysis chart is created by equal division with the number of divisions of 12. For example, in a case of 12 division patterns, lines are arranged with 100 dpi in one band. In this embodiment, when equal division is performed with the number of divisions of 12, this refers to a case where division patterns are formed at the interval of 11 nozzle lines. When the number of divisions is 3, this refers to a case where division patterns are formed at the interval of two nozzle lines, when the number of divisions is 4, this refers to a case where division patterns are formed at the interval of three nozzle lines, and when the number of divisions is k, this refers to a case where division patterns are formed at the interval of (k−1) nozzle lines.

If the number of divisions is excessively small, it is not preferable in that, since the lines written by the respective head modules overlap each other, the deposition positional deviation cannot be measured. If the number of divisions excessively increases, it is not preferable that the printing range at the time of printing is extended. Even if the number of divisions increases, measurement precision does not increase. In a head of 1200 dpi, when equal division is performed, it should suffice that division is performed by 8 divisions to 12 divisions, and the number of divisions may be appropriately changed according to the thickness of a line to be rendered and an allowable printing range.

(Step S13) Conversion Factor Calculation (Conversion Factor Calculation Step)

As an assumption for conversion factor calculation, it is assumed for calculation that (1) deposition positional deviation of one module A is shifted by +Δx with respect to deposition positional deviation of the other module B, (2) a random deposition positional deviation amount is zero.

Figure 7A:
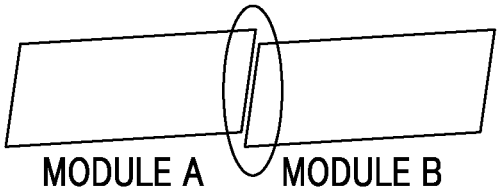
FIGS. 7A and 7B are diagrams showing nozzle arrangement near a nozzle joint portion.
Figure 7B:
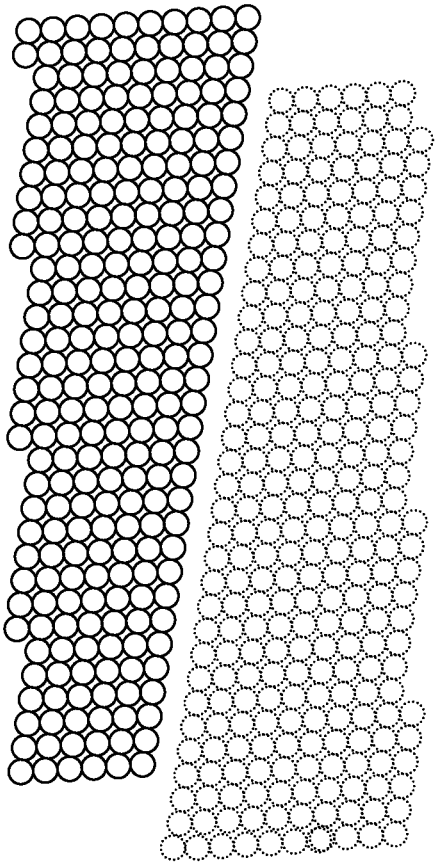
Figure 7C:
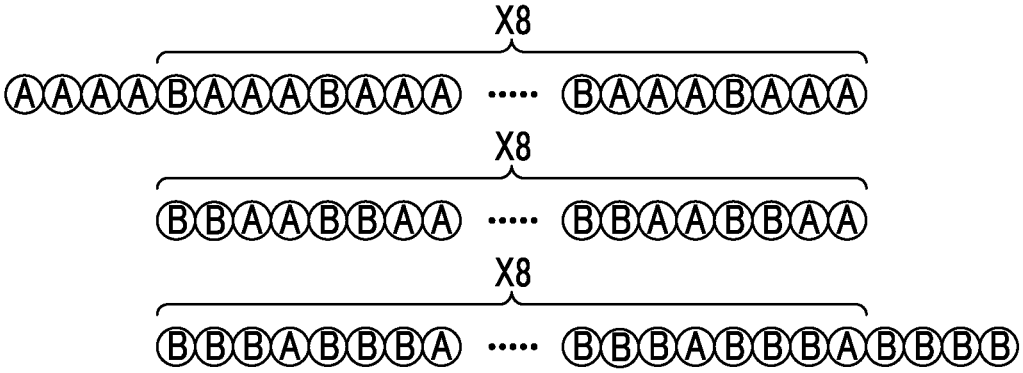
FIG. 7C is a diagram showing the relationship between a deposition position and a nozzle.

FIG. 7A is a diagram near a module joint portion of an inkjet head bar used in this embodiment, FIG. 7B shows nozzle arrangement near the joint portion, and FIG. 7C shows line arrangement when the ink droplets are ejected. As shown in FIGS. 7A to 7C, in order to fill a gap near the joint portion between head modules, the nozzles of the module A and the nozzles of the module B are arranged to be tangled near the joint portion. In this embodiment, an image is formed such that the nozzles of the module B are arranged from the left of FIG. 7C, and 96 nozzles in total of 8 cycles in a cycle of BAAA, 8 cycles in a cycle of BBAA, and 8 cycles in a cycle of BBBA are tangled so as to fill the gap between the modules.

Figure 8A:
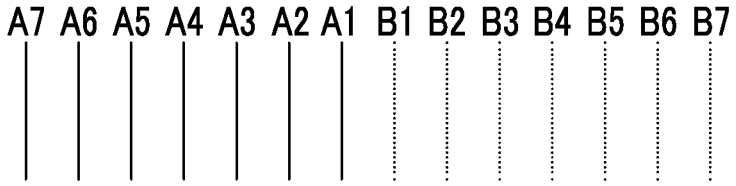
FIGS. 8A and 8B are diagrams showing the relationship between a nozzle line and a module in the division pattern of 12 divisions.
Figure 8B:
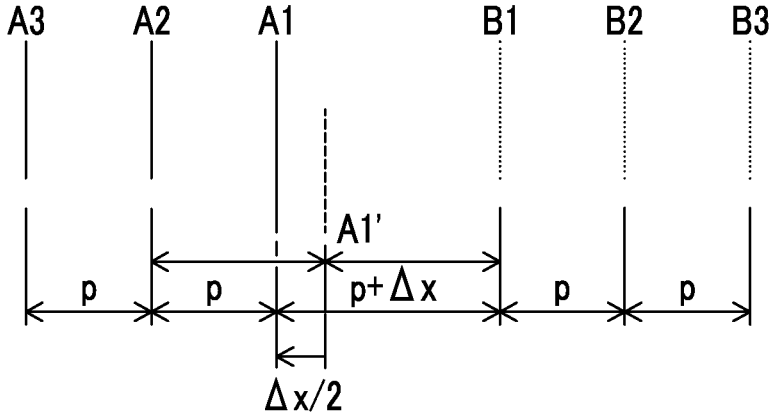
Figure 14A:
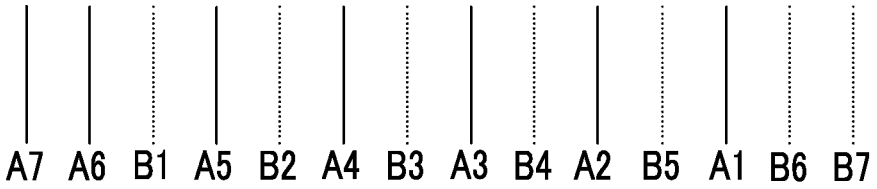
FIGS. 14A to 14D are diagrams showing the relationship between a nozzle line and a module in a division pattern of 10 divisions.
Figure 14B:
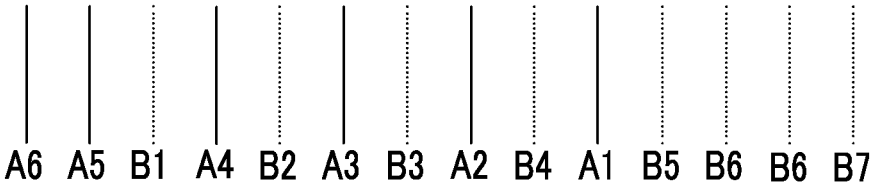
Figure 14C:
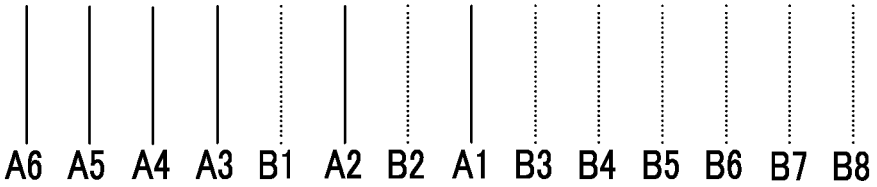
Figure 14D:
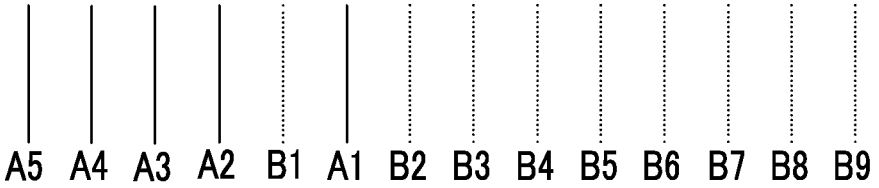

FIG. 8A shows line arrangement near a module joint portion of a band when in a case of 12 division patterns. In a case of 12 divisions, there are successive 11 bands which are the same as this band. As shown in FIG. 7C, in this embodiment, since the nozzles of the module A and the module overlap each other in a 4-nozzle cycle, in the case of 12 divisions, a combination of one type of nozzles shown in FIG. 8A is obtained. FIG. 8B is a diagram illustrating the width of a nozzle line of a band of a division pattern. Although in the same module, the width of each nozzle line is uniform and becomes p, if there is the deposition positional deviation shift amount Δx between the module A and the module B, the width of each of a nozzle line A1 and a nozzle line B1 becomes p+Δx. Accordingly, if an image is formed in this state, since droplets ejected by the module B are dropped in a portion dropped by the nozzles of the module A by a deviation amount of Δx, the droplets may overlap each other, and image quality may be degraded.

Hereinafter, as a conversion factor calculation method, a specific example will be described referring to FIG. 8B.

When obtaining a conversion factor of a certain nozzle (in this embodiment, "A1"), an approximated curve is written using a plurality of nozzles on both sides of a nozzle A1, and an ideal position of the nozzle A1 is examined. Here, an approximated curve is written using 15 nozzles on both sides of a nozzle for obtaining the conversion factor and the ideal position (deposition positional deviation amount) of the nozzle A1 is examined. When calculating the deposition positional deviation amount of the nozzle A1, since 15 nozzles on both sides of the nozzle A1 are used, and 30 lines of A16, A15, A14, . . . , A4, A3, A2, B1, B2, B3, . . . , B13, 814, and B15 are used. When calculating the deposition positional deviation amount of the nozzle A2, since 15 nozzles on both sides of the nozzle A2 are used, 30 lines of A17, A16, A15, . . . , A5, A4, A3, A1, B1, B2, . . . B12, B13, and B14 are used.

FIG. 9A shows a nozzle number for use in creating the approximated curve of the line A1 and a coordinate, and FIG. 9B show a nozzle number and a coordinate for use in creating the approximated curve of the line A2. In FIGS. 9A and 9B, the leftmost side of lines for creating an approximated curve is referred to as nozzle #1. Accordingly, the nozzle # and the nozzle position differ between FIGS. 9A and 9B. In the tables, p is a line pitch, and in this embodiment, since there are 12 division patterns of 1200 dpi, calculation is performed with p=254 μm. Calculation is performed assuming that a module joint portion deposition positional deviation amount Δx is 1 μm. When obtaining a conversion factor, since calculation is performed by dividing Δx by a deposition deviation amount, the same result is obtained even if any numerical value is used as the numerical value of Δx.

In this way, the approximated curve is created with 30 lines (heads), and the ideal positions of the line A1 and the line A2 are examined. When creating the approximated curve, the ideal position of the line A1 is obtained without using the coordinate of the line A1, and the ideal position of the line A2 is obtained without using the coordinate of the line A2, If calculation is performed, since the ideal position of the line A1 becomes −0.5 μm, and the line A1 is actually at the position of the coordinate 0, the deposition deviation amount becomes −0.5 μm by the effect of Δx=1 μm.

Since the module joint portion deposition deviation shift amount Δx can be obtained by Δx=conversion factor×deposition positional deviation amount, the conversion factor of the A1 line=Δx÷(−0.5)=1÷(−0.5) is obtained and becomes "−2".

Similarly, for the line A2, since the ideal position of the line A2 becomes −0.43 μm, and the deposition deviation amount becomes −0.43 μm, the conversion factor of the line A2 becomes Δx÷(−0.43)=1÷(−0.43)=−2.48.

Similarly, for the line A3, the line A4, the line B1, the line B2, the line B3, and the line B4, the conversion factor is obtained using 30 nozzle lines in total including 15 nozzles on both sides of a nozzle for obtaining the conversion factor.

FIG. 10 shows the result of the obtained conversion factor. In the case of 12 division patterns, since there is only line arrangement shown in FIG. 8, the sign of the conversion factor is reversed between the nozzle A1 and the nozzle B1, thereby producing a symmetric appearance.

The conversion factor is examined for the nozzles for use in (Step S14) calculation of standard error.

(Step S14) Calculation of Standard Error (Standard Error Calculation Step)

Next, the standard error is calculated using the conversion factor used in Step S13. The standard error can be obtained by the following expression.

$$\text{(standard error)}=\text{(average conversion factor value)}\times\text{(random deposition positional deviation }\sigma)\div(\sqrt{\text{the total number of nozzles for use in calculation}})$$

The minimum value of the total number of nozzles is determined by the number of nozzle lines in which the conversion factor is minimal. The random deposition positional deviation σ is a standard deviation σ of the deposition positional deviation amount of the number of nozzles of the entire bar. In this embodiment, since a bar in which 17 parallelogram modules having 2048 nozzles in one module are arranged is used, the number of nozzles of the entire bar becomes 34720.

The deposition positional deviation amount is calculated using a value actually measured. Specifically, the calculation can be performed by the same method as the calculation of the deposition positional deviation amount in Step S21, an approximated curve is created from the coordinate in an X direction (the direction perpendicular to the conveying direction of the recording medium) of each line of the printing sample, and the deposition positional deviation amount is calculated from the approximated curve. The approximated curve is created from coordinate data of N (for example, 15) lines on both lines of the line to obtain (coordinate data of the line to obtain is not used for calculation). The ideal position of the nozzle of the line to obtain is obtained from the approximated curve. The difference between the ideal position and an actual position becomes the deposition positional deviation amount of the line to obtain (relevant nozzle).

The deposition positional deviation amount is calculated by the above-described method for the number of nozzles of the entire bar, and the standard error of the deposition positional deviation amount becomes a random deposition positional deviation σ. The random deposition positional deviation σ is a value actually obtained and substantially becomes a constant by an inkjet head to be used, and in this embodiment, calculation is performed using 3 as a constant.

(Step S15) Change in the Number of Nozzles (Standard Error Calculation Step)

Next, the total number of nozzles for use in calculating the standard error is changed, and similarly to the calculation of the standard error in Step S14, the standard error is calculated. It is preferable that nozzles for use in calculation are used from a nozzle having a small conversion factor. This is because the standard error is obtained by the above-described expression, and thus a numeral value having a small conversion factor is likely to have a small standard error. A method of changing the total number of nozzles can be performed by increasing the number of nozzles by the number of nozzle lines having a conversion factor next greater than the conversion factors included in the previous calculation. The maximum value of the total number of nozzles is sufficient up to a region where the nozzles of the module A and the module B are tangled. This is because, even if the larger number of nozzles is used in calculation, there is little effect on the other module.

(Step S16) Determination of Minimum Value of Standard Error (Standard Error Calculation Step)

After the total number of nozzles is changed in Step S15, the standard error is calculated, thereby examining the number of nozzles in which the measurement error of the deposition positional deviation shift amount Δx of the modules is minimized.

By increasing the total number of nozzles for use in calculation, the denominator of the calculation expression of the standard error can be decreased. Since a nozzle separated from the other module has a large conversion factor, the numerator of the calculation expression increases. As a result, if the total number of nozzles for use in calculation increases, an error is minimal at a certain point. The number of nozzles in which the error can be minimal is determined as the number of population nozzles in 12 division patterns.

FIG. 11 shows the total number of nozzles and the result of the standard error. As shown in FIG. 11, in a case of 12 division patterns, when the total number of nozzles is 72, since the standard error decreases, it is possible to confirm that the measurement error of Δx is minimized.

In FIG. 11, in a case of the total number of nozzles of 24, since the lines A1 and B1 are used and subjected to 12 divisions, the total number of nozzles becomes 24. The average conversion factor becomes the average value of the conversion factors of the lines A1 and B1. Similarly, in a case of the total number of nozzles of 48, since the lines A2, A1, B1, and B2 are used and subjected to 12 divisions, the total number of nozzles becomes 48, and the conversion factor becomes the average value of the lines A2, A1, B1, and B2.

(Step S17) Change in the Number of Divisions (Repetition Step)

Next, the number of divisions is changed, a conversion factor is obtained by the same method as 12 divisions of Steps S13 to S16, and the number of nozzles in which a measurement error of the deposition positional deviation amount Δx of the modules is minimal, that is, the number of nozzles in which the standard error is minimal is calculated while changing the total number of nozzles.

As an example where the number of divisions is changed, a case of 11 divisions will be described.

When the number of division patterns is 11, as shown in FIGS. 12A to 12C, the arrangement near the module joint portion includes three patterns. As described above, since the nozzles used in this embodiment are in a 4-nozzle cycle, in a case of 11 divisions, the nozzles of the module A and the nozzles of the module B are tangled.

In a case of 11 divisions, the number of pattern 1 of FIG. 12A is five, the number of pattern 2 of FIG. 12B is three, and the number of pattern 3 of FIG. 12C is three.

Here, a method of obtaining the conversion factor of the line A1 in the pattern 3 of FIG. 12C will be described. The relationship between a nozzle number for use in creating the approximated curve of the line A1 and a coordinate is shown in FIG. 13. p=254 μm and Δx=1 μm are substituted to create an approximated curve. If the position (nozzle #=166) of the line A1 is obtained, the position of the line A1 becomes −0.75 μm. Since the line A1 is at the position of the coordinate zero, the deposition deviation amount becomes −0.75 μm by the effect of Δx=1 μm. The conversion factor can be obtained by inverse calculation, and becomes the conversion factor=Δx÷(−0.75)=1÷(−0.75)=−1.34.

The conversion factors of other lines are also obtained by the same method.

Although a way of obtaining a conversion factor is not shown, a pattern of 10 divisions is shown in FIGS. 14A to 14D. As shown in FIGS. 14A to 14D, in a case of 10 divisions, nozzle replacement between the module A and the module B includes four patterns of FIGS. 14A to 14D. In this case, the conversion factor can be obtained by the same method as a case of 11 divisions or 12 divisions.

FIG. 15 is a table showing the relationship of a standard error when division patterns are division by 10 divisions and when the number (population) of nozzles for use in calculation in an ascending order of conversion factors increases. As shown in FIG. 15, in a case of 10 divisions, it is confirmed that, when the number of population nozzles is 54, the deposition positional deviation shift amount Δx of the modules has a minimum value.

In this way, the number of divisions is changed, and the total number of nozzles in which the standard error is minimal is calculated in each of the division patterns corresponding to the number of divisions. The number of divisions can be appropriately set by an inkjet head to be used, and it should suffice that division patterns are performed by maximum 20 divisions.

(Step S18) Determination of the Number of Divisions and the Total Number of Nozzles (Determination Step)

Steps S12 to S17 are performed, and the number of divisions and the total number of nozzles of a division pattern for use in Δx are determined.

FIG. 16 shows the result representing the minimum value of the standard error in each division pattern by 8 divisions to 12 divisions.

As shown in FIG. 16, in regard to an inkjet head used in this embodiment, a printing pattern is divided into 9 division patterns, and the total number (population) of nozzles for use in calculation of Δx is 58, thereby minimizing the error of Δx. A printing pattern may be divided by 11 divisions, and the total number (population) of nozzles for use in calculation of Δx may be 60.

Even if a printing pattern is divided by 10 divisions, and the total number (population) of nozzles for use in calculation of Δx is 66, since the standard error is different only by 2% or less from the above-described two patterns, the nozzles can be sufficiently used in calculation of Δx.

(Step S19) Execution with Unequal Division Pattern (Division Pattern Change Step)

In Step S18, after the number of divisions and the total number of nozzles are determined, the division patterns are unequally divided, thereby further reducing the standard error. Although in the above-described division patterns, the nozzles are divided by equal division to create the printing pattern, in an unequal division pattern, this step is executed in a state where the interval of the nozzles of the band is not regular.

In regard to an unequal division pattern, although how to divide is not particularly limited, and various division patterns can be taken, it is preferable that unequal division is performed by changing the interval between arbitrary nozzles of the number of divisions determined by the determination of the number of divisions and the total number of nozzles in Step S18. This is because that, from a condition that the standard error determined with an equal division pattern is minimal, a condition for further decreasing an error can be established.

Here, a case where an equal division pattern of 11 divisions is subjected to unequal division will be described.

Figure 17A:
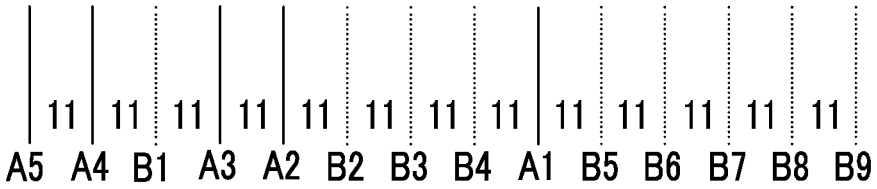
FIGS. 17A to 17C are diagrams showing an example in which an equal division pattern of 11 divisions is changed to an unequal division pattern.
Figure 17B:
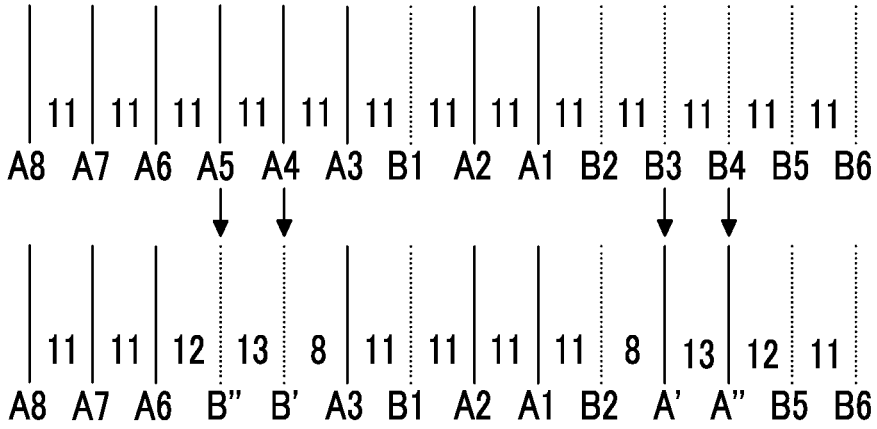
Figure 17C:
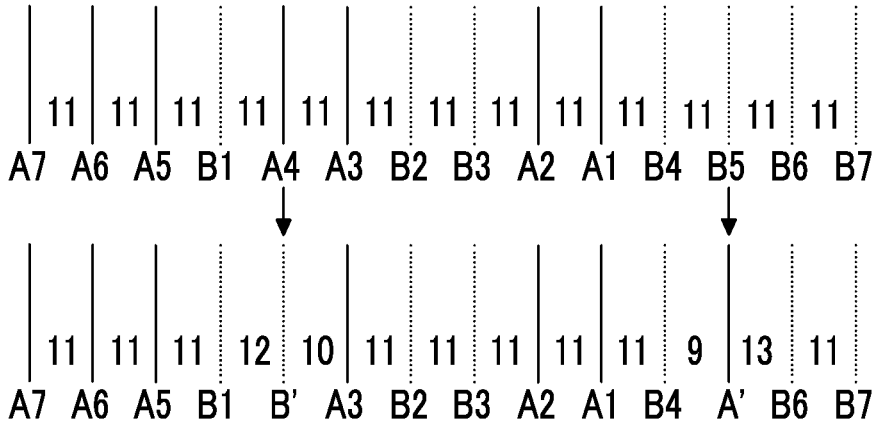

In a case of an equal division pattern of 11 divisions, as shown in FIGS. 12A to 12C, there are three types of patterns. A pattern 2 of FIG. 12B and a pattern 3 of FIG. 12C are changed to unequal division patterns. FIG. 17A shows an example where a pattern 1 remains equal division in a case of 11 divisions, and FIGS. 17B and 17C show an example where a pattern 2 and a pattern 3 are subjected to unequal division.

In this embodiment, the line A4 of the pattern 2 is changed to B', and the line A5 is changed to B". When viewed with 1200 dpi, the line A4 is changed to a line on the right side for three pixels (63.5 μm), and a pattern in which a nozzle on a different module side (module B) is used is obtained. The line A5 is changed to a line on the right side for one pixel (21.2 μm), and a pattern in which the nozzle of the module B is used is obtained. Similarly, the line B3 is changed to A', and the line B4 is changed to A". The B3 line is changed to a line on the left side for three pixels (63.5 μm), and the line B4 is changed to a line on the left side for one pixel (21.2 μm), whereby a pattern in which the nozzle of the module A is used is obtained.

Similarly, for the pattern 3, if the line A4 is changed to a line on the right side for one pixel (21.2 μm) when viewed with 1200 dpi, a pattern in which the nozzle of the module B is used can be obtained, and if the line B5 is changed to a line on the left side for two pixels (42.3 μm), a pattern in which the nozzle of the module A is used is obtained.

Next, a method of calculating a conversion factor in an unequal division pattern of the pattern 3 shown in FIG. 17C will be described. FIG. 18 is a table showing a nozzle number for use in creating an approximated curve of a line A1 and a coordinate.

Similarly to an equal division pattern, p=254 μm and Δx=1 μm are substituted to create an approximated curve. If an approximated curve is created by 30 lines, and the position (nozzle #=166) of the line A1 is obtained, the position of the line A1 becomes −0.72 μm. Since the line A1 is intrinsically at the position of the coordinate zero, the deposition positional deviation becomes −0.72 μm by the effect of Δx=1 μm. The conversion factor can be obtained by inverse calculation, and becomes the conversion factor=Δx÷(−0.72)=1÷(−0.72)=−138.

(Step S20) Determination of the Total Number of Nozzles

In this way, the conversion factor of each nozzle line of each division pattern at the time of pattern change is calculated, and the total number of nozzles in which the standard error of Δx is minimal is determined while increasing the total number of nozzles.

The result is shown in FIG. 19. As shown in FIG. 19, when measuring a standard error with an unequal division pattern shown in FIG. 17, the average value of Δx is obtained using 74 lines, thereby increasing precision compared to an equal division pattern.

In regard to an unequal division pattern, although a number of nozzles are changed to nozzles of a different module using a division pattern having a low standard error of Δx with an equal division pattern to form an unequal division pattern, a method of creating an unequal division pattern is not limited thereto, and various patterns may be created.

A standard error may be measured directly by an unequal division pattern without performing an equal division pattern. In this case, a pattern may be appropriately set.

(Step S21) Calculation of Deposition Positional Deviation Shift Amount Δx of Modules (Shift Amount Calculation Step)

When the determination of the number of divisions and the total number of nozzles in Step S18 or the calculation with an unequal division pattern in Step S19 is performed, the deposition deviation shift amount Δx of the modules is calculated with the nozzles corresponding to the number of divisions and the total number of nozzles obtained in the determination of the total number of nozzles of Step S20.

Calculation can be performed by Δx=deposition positional deviation amount×conversion factor.

In regard to the deposition positional deviation amount, the approximated curve is created from the coordinate in the X direction (the direction perpendicular to the conveying direction of the recording medium) of each line of the printing sample (analysis chart) formed with the obtained number of divisions, and the deposition positional deviation amount is calculated from the approximated curve. A method of obtaining the coordinate in the X direction of each line is not particularly limited, and for example, the printing sample may be converted to an image file by a commercially available scanner, and the coordinate in the X direction of each line may be obtained from the image file analysis. As another method, imaging using a CCD camera, or imaging by an inline sensor in a printer may be performed. The coordinate in the X direction of each line may be obtained using a microscope with a stage.

Next, an approximated curve is created using data, and a deposition deviation amount is calculated. The approximated curve is created from coordinate data of N (for example, 15) lines (coordinate data of the line to obtain is not used for calculation) on both sides of the line to obtain. The approximated curve may be, for example, a quadratic approximated curve. The ideal coordinate of the nozzle of the line to obtain is obtained from the approximated curve. The difference between the ideal coordinate and an actual coordinate becomes the deposition positional deviation amount of the line to obtain (relevant nozzle).

The deposition positional deviation amount is obtained for each nozzle and multiplied by the conversion factor of each nozzle, thereby calculating the deposition positional deviation shift amount Δx of each nozzle between the modules. When the determination of the number of divisions and the total number of nozzles in Step S18 or the calculation with an unequal division pattern in Step S19 is performed, Δx is calculated for the nozzles which are used so as to obtain the total number of nozzles in the determination of the total number of nozzles in Step S20, and the average value of Δx is obtained, thereby obtaining the deposition deviation shift amount Δx of the modules. Since the obtained deposition deviation shift amount Δx of the modules is obtained using the number of population nozzles with a small standard error, the obtained deposition deviation shift amount Δx of the modules can be obtained with high precision.

The position of the head module is adjusted on the basis of the deposition deviation shift amount Δx of the modules obtained by the above-described method, thereby further decreasing the deposition deviation shift amount Δx of the modules.

<Another Embodiment of Inkjet Head>

Figure 20A:
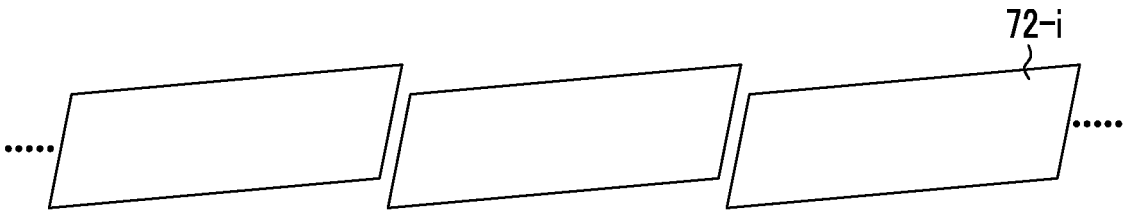
FIGS. 20A to 20C are diagrams showing another example of the shape of a head module.
Figure 20B:
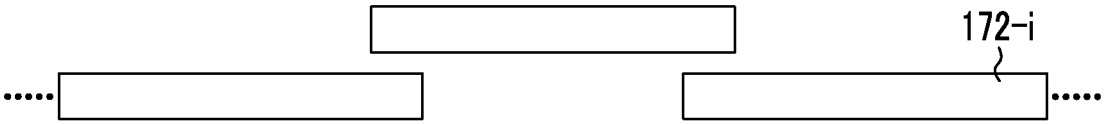
Figure 20C:
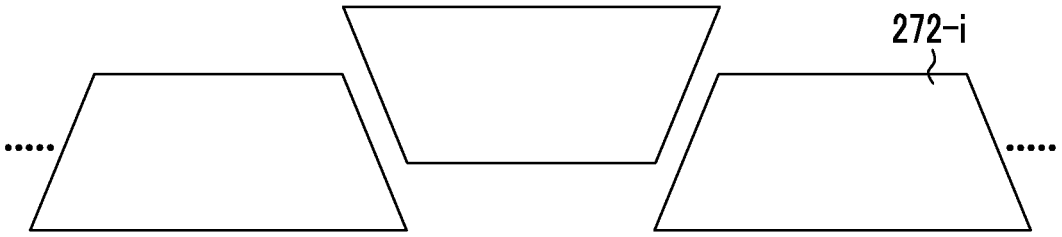

In the foregoing embodiments, although a case where the parallelogram head modules shown in FIGS. 4A and 20A are arranged has been described, the invention is not limited thereto, and may be used for an inkjet head in which quadrangular head modules 172-*i* shown in FIG. 19B are arranged so as to partially overlap each other. The invention may be applied to a case where trapezoidal head modules 272-*i* shown in FIG. 19C are arranged.

What is claimed is:

1. A method for analyzing positional deviation of head modules of an inkjet head, in which a plurality of head modules each having a plurality of nozzles ejecting a liquid arranged therein are connected and joined with each other, and adjacent head modules have overlapping regions, the method comprising:

a division pattern creation step of dividing a printing pattern by the head modules and thereby creating division patterns;

a conversion factor calculation step of obtaining conversion factors of the nozzles of each division pattern;

a standard error calculation step of changing the number of nozzles used in calculation and thereby obtain a minimum value of a standard error of a positional deviation shift amount of the head modules;

a repetition step of changing the number of divisions of the division patterns and performing the conversion factor calculation step and the standard error calculation step with the changed division patterns;

a determination step of determining the number of divisions and the number of nozzles with which the value of the standard error is minimal; and a shift amount calculation step of creating an analysis chart with the number of divisions determined in the determination step and calculating the positional deviation shift amount of the head modules based upon an average value of the positional deviation shift amounts of nozzles corresponding to the number of nozzles determined in the determination step.

2. The method for analyzing positional deviation of head modules according to claim 1, wherein, in the division pattern creation step, nozzle lines are divided at regular intervals.

3. The method for analyzing positional deviation of head modules according to claim 2, further comprising:

a division pattern change step of, after the determination step, changing at least one nozzle to a nozzle of another module and creating the division patterns with the number of divisions determined in the determination step, wherein the conversion factor calculation step and the standard error calculation step are performed with the division patterns created in the division pattern change step.

4. The method for analyzing positional deviation of head modules according to claim 3, wherein the standard error is calculated by the conversion factor×random deposition deviation/√the total number of nozzles used in the standard error calculation.

5. The method for analyzing positional deviation of head modules according to claim 3, wherein, in the standard error calculation step, the nozzles are used in an ascending order of the conversion factors, and thereby the standard error is calculated.

6. The method for analyzing positional deviation of head modules according to claim 2, wherein the standard error is calculated by the conversion factor×random deposition deviation/√the total number of nozzles used in the standard error calculation.

7. The method for analyzing positional deviation of head modules according to claim 2, wherein, in the standard error calculation step, the nozzles are used in an ascending order of the conversion factors, and thereby the standard error is calculated.

8. The method for analyzing positional deviation of head modules according to claim 1, further comprising:

a division pattern change step of, after the determination step, changing at least one nozzle to a nozzle of another module and creating the division patterns with the number of divisions determined in the determination step, wherein the conversion factor calculation step and the standard error calculation step are performed with the division patterns created in the division pattern change step.

9. The method for analyzing positional deviation of head modules according to claim 8, wherein the standard error is calculated by the conversion factor×random deposition deviation/√the total number of nozzles used in the standard error calculation.

10. The method for analyzing positional deviation of head modules according to claim 8, wherein, in the standard error calculation step, the nozzles are used in an ascending order of the conversion factors, and thereby the standard error is calculated.

11. The method for analyzing positional deviation of head modules according to claim 1, wherein, in the division pattern creation step, nozzle lines are divided with the interval of the nozzles being irregular.

12. The method for analyzing positional deviation of head modules according to claim 11, wherein the standard error is calculated by the conversion factor×random deposition deviation/√the total number of nozzles used in the standard error calculation.

13. The method for analyzing positional deviation of head modules according to claim 11, wherein, in the standard error calculation step, the nozzles are used in an ascending order of the conversion factors, and thereby the standard error is calculated.

14. The method for analyzing positional deviation of head modules according to claim 1, wherein the standard error is calculated by the conversion factor×random deposition deviation/√the total number of nozzles used in the standard error calculation.

15. The method for analyzing positional deviation of head modules according to claim 1, wherein, in the standard error calculation step, the nozzles are used in an ascending order of the conversion factors, and thereby the standard error is calculated.

16. The method for analyzing positional deviation of head modules according to claim 1, wherein the positional deviation shift amount of the head modules in the shift amount calculation step is obtained by the conversion factor of each nozzle×the positional deviation amount, and an approximated curve is created using nozzle lines of division patterns on both sides of the nozzle of the analysis chart and the positional deviation amount is obtained by the difference between the position of the approximated curve of the corresponding nozzle and an actual deposition position.

17. The method for analyzing positional deviation of head modules according to claim 16, wherein the approximated curve is created using fifteen nozzle lines on both sides of the corresponding nozzle.

18. A non-transitory computer readable recording medium having a program recorded thereon causing a computer to execute the method for analyzing positional deviation of head modules according to claim 1.

19. A method for adjusting an inkjet head for adjusting the positions of head modules using a positional deviation shift amount $\Delta x$ of the head modules measured by the method for analyzing positional deviation of head modules according to claim 1.

* * * * *